US005636405A

United States Patent [19]

Stone et al.

[11] Patent Number: 5,636,405

[45] Date of Patent: Jun. 10, 1997

[54] FINGER TOOTHBRUSH/HANDLE-LESS TOOTHBRUSH

[76] Inventors: Cheryl F. Stone; Larry W. Stone, both of Box 43, New Point, Va. 23125

[21] Appl. No.: 658,946

[22] Filed: May 31, 1996

Related U.S. Application Data

[63] Continuation-in-part of Ser. No. 447,728, May 19, 1995.

[51] Int. Cl.[6] ..... A46B 1/00; A46B 5/04; A46B 9/04

[52] U.S. Cl. ..... 15/167.1; 15/187; 15/227; D4/103

[58] Field of Search ..... 15/167.1, 187, 15/188, 227; D4/103

[56] References Cited

U.S. PATENT DOCUMENTS

| | | | |
|---|---|---|---|
| 2,018,903 | 10/1935 | Stevens | 15/227 X |
| 2,396,548 | 3/1946 | Allen | 15/227 X |
| 4,251,897 | 2/1981 | Alam | 15/227 X |
| 4,617,694 | 10/1986 | Bori | 15/227 X |
| 5,287,584 | 2/1994 | Skinner | 15/227 X |

FOREIGN PATENT DOCUMENTS

| | | | |
|---|---|---|---|
| 544720 | 4/1942 | United Kingdom | 15/227 |

*Primary Examiner*—Mark Spisich

[57] ABSTRACT

A dental hygiene device that is a finite one-piece tapered tube with a rectangularly shaped mass of integrally formed molded bristle-like projections. The device is designed to promote dental hygiene in specific situations where a conventional toothbrush is not appropriate. The design closely mimics the design and action of a conventional toothbrush while substituting a finger or other like shaped shaft for the elongated handle. This mounted device permits the reaching of all tooth surfaces while maintaining the same standard of oral hygiene which is expected through brushing with the conventional design. This improved design corrects the deficiencies noted in earlier designs while continuing to provide a device which will remain in place while in use but which at the same time will be cost effective to manufacture. The device is intended to provide a suitable substitute for the conventional toothbrush. Its performance is consistent with a conventional design toothbrush and, line the conventional design, it is reusable.

3 Claims, 1 Drawing Sheet

FINGER TOOTHBRUSH/HANDLE-LESS TOOTHBRUSH

CROSS-REFERENCE TO RELATED APPLICATION

This application is a continuation-in-part of application Ser. No. 08/447,728, filed 19 May 1995, pending.

FIELD OF THE INVENTION

This invention relates to a novel oral hygiene device. More particularly, this invention pertains to a distinctive toothbrush which can fit on the user's finger or other similar shaped shaft such as a prosthesis.

1. Background of the Invention

Although the standard toothbrush works well under certain conditions, there are times when its design does not always provide the most efficiency and flexibility in cleaning the teeth. Although research has discovered a number of finger mounted devices patented over the years, further study of these devices elicited several deficiencies which this design overcomes. Such deficiencies include instability on the finger as well as closed surfaces which tends to promote bacterial growth. In seeking to overcome these deficiencies, this design satisfies the highest utility standards while at the same time being as hygienic as possible.

2. Description of Prior Devices

This device is specifically designed to be reusable and to be able to maintain its cleaning effectiveness as compared to the devices covered by: U.S. Pat. Nos: 5,348,153 (Cole), 5,213,428 (Salman), 4,251,897 (Alam), 4,134,172 (Arce), 3,105,260 (Smith), 1,894,413 (Nenning) which are all intended to be disposable. This device has a non-porous surface with no hidden areas which would create the potential of bacterial growth, such as demonstrated in: U.S. Pat. Nos: 5,068,941 (Dunn), 4,628,949 (Mas), 2,686,325 (Silver), 2,018,903 (Stevens), 1,965,009 (Stevens), 1,946,283 (Hoffman), 1,894,413 (Nenning), 628,185 (Richards), 128,093 (Allerton) and 398,919 (U.K.) all of which are closed-end devices providing the ideal environment to promote bacterial growth. U.S. Pat. No. 5,287,584 (Skinner) and U.S. Pat. No. 544,720 (U.K.) work on a finger gripper basis which does not have the ease in fit and motion which this design embodies. U.S. Pat. No. 4,679,274 (Friedman) is rigid and extends beyond the finger, eliciting similar complaints as with the rigid handle of a conventional toothbrush. U.S. Pat. No. 2,921,590 (Holton) relies on strip adhesives which do not provide stability on the finger which is necessary for effective motion and U.S. Pat. No. 2,915,767 (Vaughan) has a slit for the finger presenting some of the defects noted above. U.S. Pat. No. 4,617,694 (Bori) presents a complex device with multiple surfaces, which increases the bacteria risk, and an elaborate bristle design. Finally U.S. Pat. Nos. 398,919 (U.K.) and 544,720 (U.K.) have thickened segments or portions at the bristle site for mounting the bristles, whereas this design incorporates a one piece finitely expandable tapered tube with a rectangular shaped mass of integrally formed molded bristle-like projections without incurring additional thickness of the tapered tube at their base site.

SUMMARY OF THE INVENTION

This invention, a dental hygiene device, is to be the ultimate finger or handle-less toothbrush in that it will effectively clean the teeth and does not have hidden cavities which will promote bacteria growth. The device incorporates a tapered tube containing expansion sectors to provide finite tube diameter expansion. This tapered tube, with a rectangular shaped mass of integrally formed molded bristle-like projections, is constructed of non-stretchable material such as injection mold grade low density polymerized ethylene resin (polyethylene) with a density of 0.915 to 0.926 grams/cc as measured by ASTM D1505 method and with an elongation at yield value of less than 125.0 percent as measured with ASTM D638 method or other suitable non-stretchable polymer that meets United States Food and Drug Administration Regulation 177.1520 approval for oral contact. This tapered tube covers only the distal end of the finger or other similar shaped mounting device, such as a prosthesis. The device will remain stable while permitting the finger or other similar shaped mounting device to provide movement. The interior surface of the expandable tapered tube is smooth and contains no cavities, protrusions, projections or other formations that deviate from the surface plane of the interior surface. The exterior surface likewise is smooth in all areas without molded bristle-like projections with the possible exception of words or numbers molded into the exterior surface of the tube referencing the patent status and the manufacturer.

The device incorporates expansion sectors in the tapered tube walls running parallel to the tube length. The expansion sectors may be located equally distance apart half way up the tapered tube from the bristle-like projection side of the device or they may be located at three equally spaced locations on the tapered tube wall with the two of the sectors as previously described and the third sector 180° from the rectangular bristle mass. These sectors ensure that the devices' expansion on a finger or other similar shaped mounting device is finite when mounted. These expansion sectors are sections of the tapered tube which are significantly thinner than the tapered tube wall. The thinner expansion sectors can be made with a cross section having the exterior surface concave or with a greater angle at the interface between the tapered tube wall and the expansion sector. The polymer in the expansion sectors exhibit the characteristics of injection mold grade low density polymerized ethylene resin (polyethylene) with a density of 0.915 to 0.926 grams/cc and with an elongation at yield value of less than 125.0 percent or other suitable non-stretchable polymer that is United States Food and Drug Administration approved for oral contact. The elongation at yield value allows a finite lengthening in the thinner expansion sections, providing longer overall circumference of the tapered tube. This lengthening comes from the exerted pressure of mounting the device. The tube walls are moved farther apart thereby expanding the diameter of the tapered tube a finite amount. The expansion sectors allow a compression fit of the device on the finger or other similar shaped shaft over a finite range of finger and other similar shaped shaft sizes.

As the tapered tube is open at both ends and is constructed of injection mold grade low density polymerized ethylene resin (polyethylene) or other suitable polymer that is Food and Drug Administration approved for oral contact, the device provides both a cleaner surface and a bacteria-free environment, while at the same time being suitable for all fingernail lengths when finger mounted.

The length of the molded bristle-like projections in the rectangular shaped mass of integrally formed molded bristle-like projections is shorter than the bristles in a conventional child's toothbrush. This rectangular shaped mass of shorter integrally formed molded bristle-like projections will compensate for the added width in the mouth necessitated by a finger or other similar shaped mounting device. The rectangular shaped mass of integrally formed molded bristle-like projections has an area density of between 124 and 250 projections per square inch. This rectangular shaped mass of integrally formed molded bristle-like projections can be in any row or spacing configuration that gives the area density of between 124 and 250 projections per square inch. In addition, these projections are integral to the expandable tapered tube with the tube wall being of a consistent thickness with the exception of the expansion sectors which are significantly thinner thus simulating the conventional concept of a brush head.

Thus, it is an object of the invention to provide the ultimate finger or handle-less toothbrush that is reusable and one that provides effective cleaning of teeth while not promoting bacteria growth.

Another object of the invention is to provide a reusable handle-less, finger tip dental hygiene device that the diameter of the tapered tube withstands finite expansion to fit a person's finger or other similar shaped shaft.

These and other features and advantages of the present invention will become clearer and more apparent upon review of the detailed description set forth below when viewed in conjunction with the following drawings of the invention.

DETAILED DESCRIPTION OF THE PREFERRED EMBODIMENT

Figure 1:
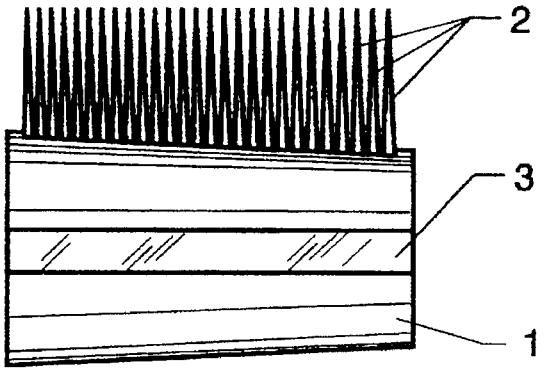
FIG. 1—a side view of the device as would appear on the finger or other similar shaped shaft.
Figure 2:
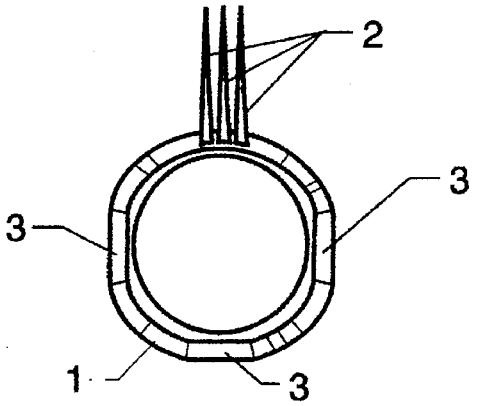
FIG. 2—a straight on view from the distal end of the device.
Figure 3:
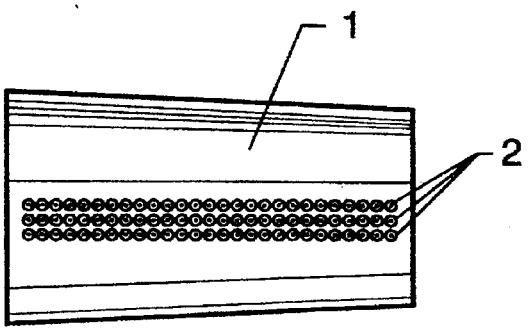
FIG. 3—a top view looking down on the tapered tube with a rectangular shaped mass of integrally formed molded bristle-like projections.
Figure 4:
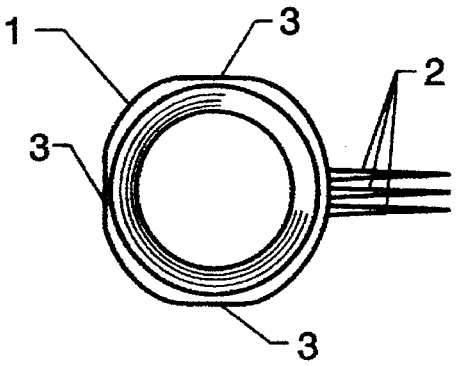
FIG. 4—a straight on view from the distal end of another embodiment of the device.

Referring to the drawings, FIG. #1 denotes the expandable tapered tube with the rectangular shaped mass of integrally molded bristle-like projections and expansion sectors (1). The rectangular shaped mass of integrally formed molded bristle-like projections which are shorter than the conventional design in order to provide greater flexibility in movement and ease in cleaning the teeth, are denoted in FIG. 1, FIG. 2 and FIG. 3 as (2). In FIG. 1, the expansion sectors (4) denotes the thinner sectors for finite expansion. FIG. 2 (4) denotes the expansion sectors in the non-stretchable tapered tube and (5) denotes the tapered tubes walls. FIG. 3, the top or utility surface (2) denotes the rectangular shaped mass of integrally formed molded bristle-like projections designed to insure uniform dental hygiene. FIG. 4, (4) denotes the expansion sectors in the non-stretchable tapered tube.

What is claimed is:

1. A dental hygiene device, comprising:

(a) an elongated hollow tubular member open at first and second opposite ends thereof, said tubular member tapering from the first end to the second end thereof, said tubular member further including a top portion, a bottom portion and first and second opposite side portions disposed between said top and bottom portions, the inner periphery of said tubular member defining a substantially smooth surface and the tubular member having a substantially constant wall thickness along the entire length thereof, the tubular member being made of a plastic material which is substantially rigid and non-stretchable;

(b) a plurality of plastic bristles projecting from said bottom portion, said plurality of bristles being integrally formed and molded with said tubular member;

(c) a plurality of expansion sectors disposed about the outer periphery of the tubular member and defining reduced thickness areas in the wall of the tubular member, said expansion sectors comprising recessed portions extending along the entire length of the tubular member, said expansion sectors respectively located at each of the first and second side portions, said expansion sectors providing finite circumferential growth and diameter expansion of the tubular member thereby creating a compression fit when mounted on a finger of a user; and (d) the device being adapted to be worn on the finger of the user during brushing of his/her teeth.

2. The dental hygiene device of claim 1 further including an expansion sector at the top portion of the tubular member.

3. The dental hygiene device of claim 1 wherein the plurality of bristles define a rectangular area extending substantially the entire length of the tubular member at the bottom portion thereof.

* * * * *